US009476677B1

(12) United States Patent
Wright et al.

(10) Patent No.: US 9,476,677 B1
(45) Date of Patent: Oct. 25, 2016

(54) LONG RANGE KV-TO-KV COMMUNICATIONS TO INFORM TARGET SELECTION OF FOLLOWER KVS

(71) Applicant: Raytheon Company, Waltham, MA (US)

(72) Inventors: Richard J. Wright, Tucson, AZ (US); James G. Sierchio, Tucson, AZ (US); Myron E. Calkins, Jr., Tucson, AZ (US); Kent P. Pflibsen, Tucson, AZ (US); Perry H. Frahm, Tucson, AZ (US); William R. Owens, Tucson, AZ (US); Thomas M. Crawford, Marana, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/730,884

(22) Filed: Jun. 4, 2015

(51) Int. Cl.
*F41G 7/30* (2006.01)
*F41G 7/22* (2006.01)

(52) U.S. Cl.
CPC ..... *F41G 7/308* (2013.01); *F41G 7/2206* (2013.01); *F41G 7/2233* (2013.01); *F41G 7/2293* (2013.01)

(58) Field of Classification Search
None
See application file for complete search history.

(56) References Cited

U.S. PATENT DOCUMENTS

| | | | | |
|---|---|---|---|---|
| 6,666,401 | B1 * | 12/2003 | Mardirossian | F41G 7/303 244/3.1 |
| 7,494,089 | B2 | 2/2009 | Williams et al. | |
| 7,494,090 | B2 | 2/2009 | Leal et al. | |
| 8,288,696 | B1 * | 10/2012 | Boka | F42B 10/66 244/3.1 |
| 9,157,717 | B1 * | 10/2015 | Carroll | F42B 15/01 |

* cited by examiner

*Primary Examiner* — Stephen M Johnson
(74) *Attorney, Agent, or Firm* — Eric A. Gifford

(57) ABSTRACT

A KV-based missile defense system and method of strategic engagement provides performance improvement for both singleton and raid scenarios by launching multiple interceptors that place a follower KV in a trailing position with respect to a lead KV. Knowledge of the target cloud gained by the lead KV is transmitted to the follower KV and incorporated to inform the target selection of the follower KV. The follower KV trails the lead KV with sufficient spacing in time and distance to select a target and maneuver to engage the target pre-acquisition. This also allows the follower KV to receive and incorporate knowledge of target impact by the lead KV. This knowledge may be transmitted back to another follower KV and so forth in a "string" of KVs to inform target selection and down to the ground to inform strategic engagement. Updated non-KV observational data can be uplinked and transmitted forward along the string to the lead KV.

21 Claims, 7 Drawing Sheets

LONG RANGE KV-TO-KV COMMUNICATIONS TO INFORM TARGET SELECTION OF FOLLOWER KVS

BACKGROUND OF THE INVENTION

1. Field of the Invention

This invention relates to ballistic missile defense systems that use an interceptor to boost one or more Kill Vehicles (KVs) onto a ballistic intercept trajectory to intercept a ballistic missile and the KV's own sense capability and propulsion to autonomously select a target and maneuver to impact, and more particularly to a method of strategic engagement that uses long-range communications between KVs boosted from different interceptors to transmit back observed sensor data and processed mission data from leading KVs to inform target selection and improve the efficacy of follower KVs.

2. Description of the Related Art

The Ground-Based Midcourse Defense (GMD) element of the Ballistic Missile Defense System (BMDS) as currently fielded is the only available defense system the United States has against long range Inter-Continental Ballistic Missiles (ICBMs). The GMDS has a single type of Ground Based Interceptor (GBI), with the payload being the Exo-atmospheric Kill Vehicle (EKV). Each has a single kinetic-energy based warhead i.e., a KV, that is, boosted on an interceptor. The KV is designed to destroy a target via the kinetic energy upon impact.

The system takes input from a series of forward sensors including radars and satellites, and responds to a detected incoming threat by developing the data needed to launch interceptors at it. The individual KVs launched each perform the same mission, where the KV has to acquire the incoming threat booster and whatever components have come free from it (shrouds, adapters, debris, a warhead, and possibly countermeasures, for example), and use direct observations to discriminate between the warhead and functionally inert pieces of the missile. The KV is aided by additional data sent from the ground in flight to provide the latest available radar observations on the threat object, now termed a target cloud after payload separation. In-flight and post-boost phase Communications Events (CE) include those transmitted from the ground station, and those transmitted from the KV.

The KV takes the available ground data and combines its own infrared (IR) observations, and picks the target to intercept based on existing onboard algorithms. Each KV fired at an approaching target cloud prosecutes its mission as though it were the only intercept attempt being made. Each KV acts "autonomously", making the final target selection and engagement decisions on its own albeit using data from other sources.

Because the current firing doctrine requires a large number of GBIs to be launched to achieve the requisite Probability of Engagement Success (Pes) against any one target cloud, and the limited ready GBI inventory, the GMD element can only engage a limited number of targets. Additional BMDS limitations include the number of GBIs in the ready inventory and the number of In-Flight Interceptor Communications System (IFICS) sites able to send and receive data from KVs in flight at one time.

The Multiple Kill Vehicle was a planned U.S. missile defense system designed to deploy multiple small kinetic energy-based warheads (MKEWs) from a single booster that can intercept and destroy multiple ballistic missiles. The MKEWs were configured for short-range communications with the CV and amongst themselves to manage the threat engagement. See U.S. Pat. Nos. 7,494,090 and 7,494,089. The MKV program was terminated in 2009.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides for a KV-based missile defense system and method of strategic engagement that provides performance improvement for both singleton and raid scenarios to reduce the number of KVs required to produce the requisite Pes. This in turn increases the number of threats the GBI inventory can engage.

This is accomplished by launching multiple interceptors that place a follower KV in a trailing position with respect to a lead KV. Knowledge of the target cloud gained by the lead KV is transmitted to the follower KV and incorporated to inform the target selection of the follower KV. The follower KV trails the lead KV with sufficient spacing in time and distance to maneuver to the selected target. This knowledge may be transmitted back to another follower KV and so forth in a "string" of KVs to inform target selection and maneuver the KV to the target.

In an embodiment, ballistic targets are intercepted by launching a lead interceptor having a lead KV on a first ballistic trajectory to intercept a target cloud and separating the lead KV from the lead interceptor, and launching a follower interceptor having a first follower KV on a second ballistic trajectory to intercept the target cloud and separating the first follower KV from the follower interceptor in a trailing relationship to the lead KV. The lead KV collects and processes observational sensor data to discriminate targets within the target cloud and select a target from the target cloud autonomously. The lead KV maneuvers to remove insertion error and intercept the selected target while transmitting the observational sensor data and processed mission data via a communications link. The first follower KV receives the observational sensor data and processed mission data from the lead KV via a communications link, collects and processes both the received observational sensor data from the lead KV and its own observational sensor data to select a target from the target cloud autonomously. The first follower KV maneuvers to remove insertion error and intercept the selected target. The first follower KV may transmit the accumulated observational sensor data and processed mission data to a second follower KV to inform its target selection.

In an embodiment, the communications link for KV-to-KV communications does not require KV reorientation to conduct a CE. The communications link may comprise a steerable data link antenna (SDLA), separate fixed data link antennas forward and aft, or an alternative dedicated communications method such as a laser.

In an embodiment, the launch of the follower interceptor is timed relative to the launch of the lead interceptor to space the KVs such that the first follower KV receives an initial transmission of observational sensor data and processed mission data from the lead KV before the first follower KV is within range to discriminate targets from its own observational sensor data i.e., pre-acquisition. The first follower KV selects the target and maneuvers based on the initial transmissions. By making its initial maneuver pre-acquisition, the follower KV can conserve fuel for terminal maneuvers. This also enables less-capable KVs, ones with limited sense or maneuver capability, to be used as follower KVs. The KVs may be spaced such that the follower KV receives a final transmission from the lead KV before the follower KV acquires the target. The KVs may be spaced to the limits of the communications link to maximize the benefits of an early maneuver.

In an embodiment, the launch of the follower interceptor is timed relative to the launch of the lead interceptor to space the KVs such that the first follower KV combines higher-resolution observational sensor data over a smaller Field of View (FOV) with its own lower-resolution observational sensor data over a larger FOV to inform its target selection. The lead KV provides high-resolution data for a limited portion of the target cloud while the follower KV collects low-resolution data for the entire target cloud. This affords the follower KV the opportunity, based on the lead KV's knowledge, to change course and select a new target in the larger FOV.

In an embodiment, the lead KV collects and makes a final transmission of observational sensor data just prior to impact with the target. This provides both the best picture of the target and timely information on whether the lead KV's target selection was correct to inform target selection of the follower KV(s).

In an embodiment, the lead KV comprises an impact sensor. The lead KV collects impact data and transmits the impact data after impact and before the KV is destroyed. The follower KV processes the impact data to inform its own target selection. In an embodiment, the impact sensor is calibrated to measure an amount of material consumed by the impact to classify the impacted object.

In an embodiment, the first follower KV collects observational sensor data of the lead KV impacting the target and processes that data to inform its target selection.

In an embodiment, a plurality of N interceptors is launched in a spaced sequence to intercept the target cloud. The observational sensor data and processed mission data is passed backwards from one KV to the next. As each KV passes over a surface-based station, the observational sensor data and processed mission data is transmitted down to the surface-based station. This information can be used both to manage the current strategic engagement as well as to inform target discrimination and selection for future engagements.

In an embodiment, a plurality of N interceptors is launched in a spaced sequence to intercept the target cloud. As each KV passes over a surface-based station, updated processed non-KV observational sensor data (e.g. ground radar data) is transmitted up to the KV. From the uplinked KV, the updated processed non-KV observational sensor data is transmitted forward from one KV to the next. This allows the lead or forward most KVs to receive the most current information available from other sources.

In different embodiments, the lead and follower interceptors may be an unitary or multiple KV systems or a combination thereof. For example, the lead interceptor may boost a single KV with high sense and maneuver capability and the follower interceptor may boost multiple MKEWs each with lower sense and maneuver capability. In another example, the lead and follower interceptors may both be KV but the follower KVs may have less sense and maneuver capability. In different embodiments, all of the interceptors may be launched from the same location or the interceptors may be launched from different locations.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a KV-based missile defense system and method of strategic engagement provides performance improvement for both singleton and raid scenarios by launching multiple interceptors that place a follower KV in a trailing position with respect to a lead KV. Knowledge of the target cloud gained by the lead KV is transmitted to the follower KV and incorporated to inform the target selection of the follower KV. The follower KV trails the lead KV with sufficient spacing in time and distance to maneuver to the selected target. This may allow the follower KV to make a target selection and perform its initial maneuver pre-acquisition. This also allows the follower KV to receive and incorporate knowledge of target impact by the lead KV. This knowledge may be transmitted back to another follower KV and so forth in a "string" of KVs to inform target selection and initiate maneuvers and down to the ground to inform strategic command. Updated non-KV observational data can be uplinked and transmitted forward along the string to the lead KV.

Figure 1A:
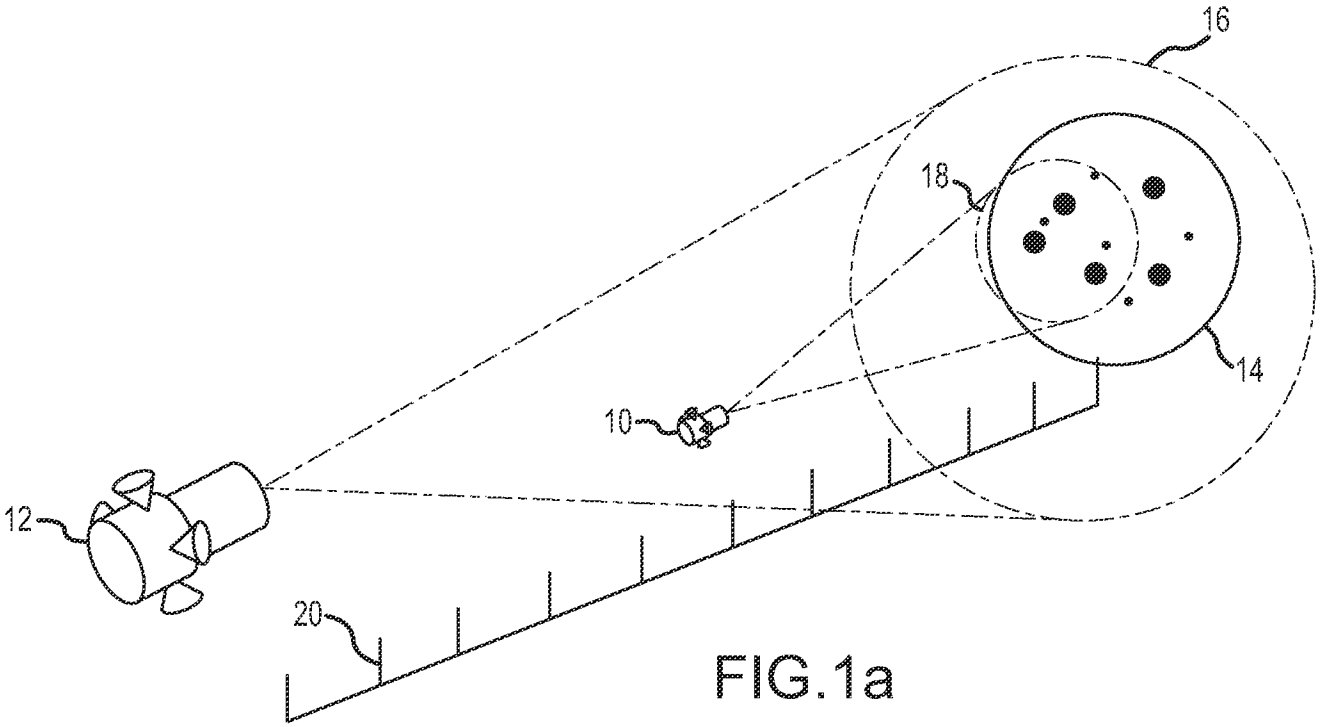
FIGS. 1*a* and 1*b* are diagram illustrating the available action radius and view of a target cloud in a leader-follower KV string.
Figure 1B:
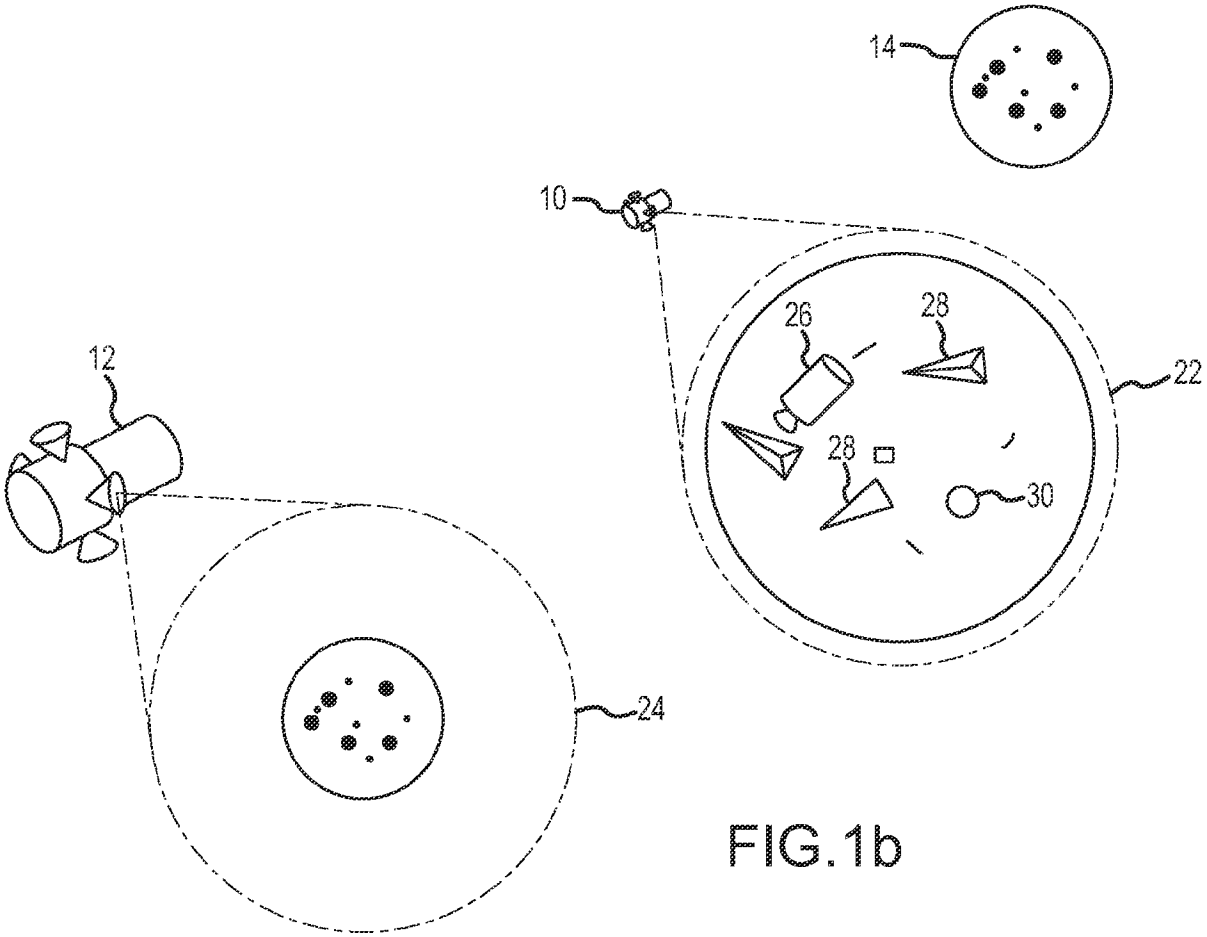

The principle advantages of launching multiple interceptors to form a string of leader and follower KVs, 10 and 12 respectively, to cooperatively engage a target cloud 14 are illustrated in FIGS. 1*a* and 1*b*. Knowledge of the target cloud gained by the lead KV is transmitted to the follower KV and incorporated to inform the target selection of the follower KV. Assuming equally capable KVs, the action radius 16 of follower KV 12 is larger than the action radius 18 of lead KV 10 due to the additional distance 20 of the follower KV 12 to the target. As also shown, the view 22 of the target cloud 14 from lead KV 10 is more highly resolved than the view 24 from follower KV 12 due to the relatively close proximity of the lead KV 10 to the target cloud allowing for enhanced discrimination and target selection of individual objects in the target cloud including a warhead 26, decoys 28 and debris 30.

Launching a string of KVs to cooperatively engage a target cloud allows each subsequent interceptor and KV to improve the probability of threat negation based on information from the previous KV's engagement. The follower KV gets complete target cloud discrimination early, foreknowledge of the lead KV behavior and ability to interpret intercept observations to correctly select and engage its own target. This reduces the number of KVs required to produce the requisite Pes, which in turn increases the number of threats the GBI inventory can engage. This type of cooperative engagement also allows less capable KVs, once that could not on their autonomously engage the target cloud, to be effectively deployed and launched from different launch sites.

Figure 2:
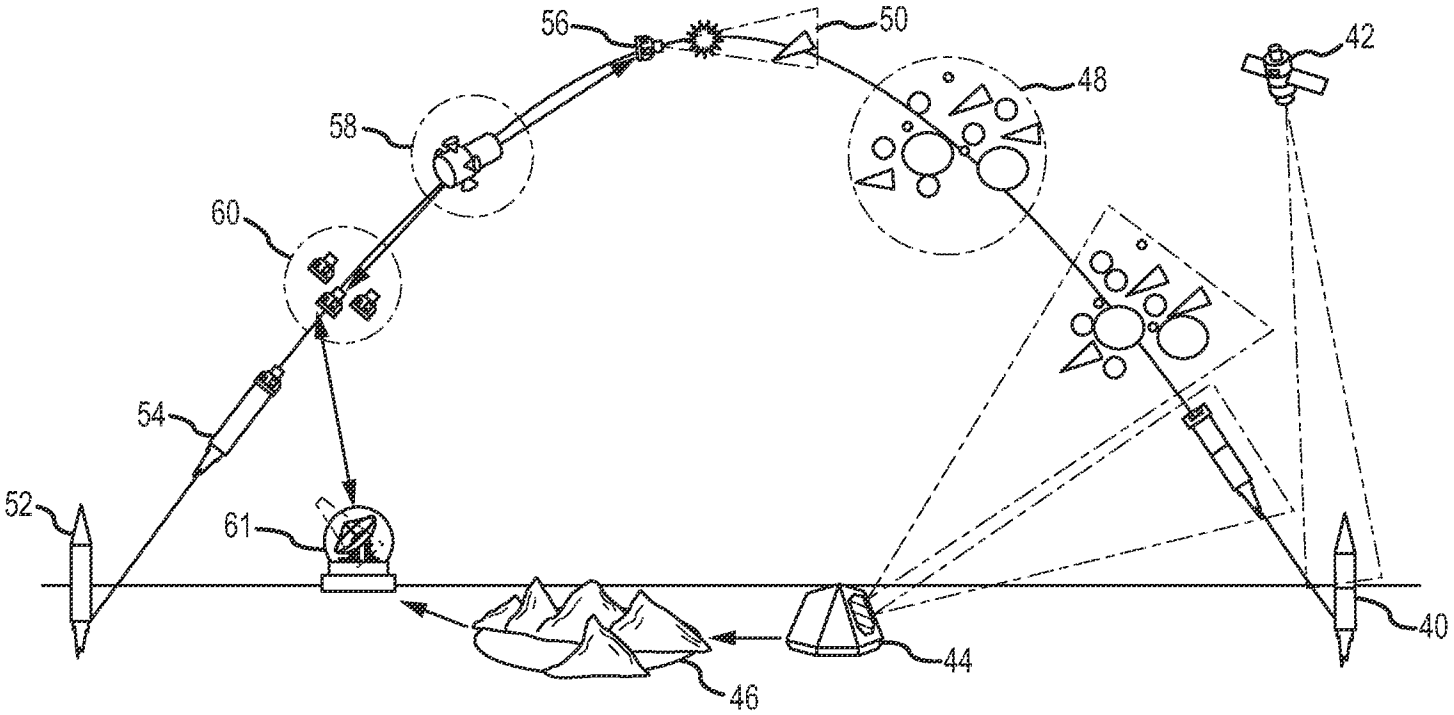
FIG. 2 is a diagram of an embodiment of an interceptor launch scenario to form a string of KVs in a leader-follower relationship to engage a target cloud.

Referring now to FIG. 2, in an embodiment a threat 40 such as a nuclear-armed missile is launched at the United States or ally. The launch is detected by a sensor network including satellites 42 and forward-deployed ground or sea-based radar 44 and communicated to a command center 46. The sensor network detects and tracks the threat 40 (now termed a target cloud 48 after payload separation including the incoming threat booster and whatever components have come free from it including shrouds, adapters, debris, a warhead, and possibly countermeasures), as it travels along a ballistic path 50 and towards its intended target.

Command Center 46 orders a salvo of Leader/Follower KV—equipped Ground Based Interceptors (GBIs) 52 to be launched on a ballistic trajectory 54 against the incoming threat. Real-time feedback shows when each interceptor is automatically selected, armed, and fired in a timed sequence to produce a desired spacing of the KV flight paths.

The first GBI is launched to make a lead intercept of the threat. A lead KV 56 separates from the interceptor and continues on to the target. Lead KV 56 is preferably a highly capable KV (e.g. sensor and maneuver capability) as provided by a current generation EKV. Alternately the lead KV could be a less capable KV or even multiple KVs. Second and then third GBIs are launched to make follower intercepts of the threat. A first follower KV 58 separates from the interceptor and continues on to the target. The follower KV 58 may be a single less-capable KV (as shown), a single KV of equivalent capability to lead KV 56 or multiple MKEWs. Multiple second follower MKEWs 60 separate from the interceptor and continue on to the target. As shown, the second follower MKEWs 60 are smaller less-capable KVs. Alternately, the second follower KV could be a single KV or equivalent or less capability than the lead or first follower KV. Launching multiple interceptors to place KVs in a "string" to cooperatively engage a threat allows for great flexibility to select and combine various interceptor and KV capabilities on-hand to defeat the threat.

The KVs are retrofit or designed to support long-range KV-to-KV communications. Existing KVs are commonly in a state where they can either communicate with the ground or point their nose at the target and engage. Once a KV has acquired a target, there is no opportunity to send or receive data. The leader follow KVs must include a communications link that allows for long-range KV-to-KV communications both pre and post-acquisition.

The KVs are retrofitted or designed to integrate observational sensor data (e.g., a map of objects extracted from IR imagery or MOT (Multi-Object Track) and directly measured properties of those objects) and processed mission data (e.g., KV health and status, interpretation of the observational sensor data and mission activities) from a leading KV with the standard data package. The MOT is directly usable by a follower KV because the MOT is in exactly the same format as data received from its own sensor. KV health and status includes the current status of the KV and its fitness to continue its mission (e.g. communications status, fuel state, sensor operability etc.). The interpretation of observational sensor data analysis includes, for example, results of its sensor performance, detected scene features, analysis results, objects detected, target discrimination results, derived object properties, and rejected countermeasures. Mission activities include, for example, calculated results such as the selected target, expected flight path to target, time remaining to intercept, calculated range to target, correlation of sensor data to forward posted target data, and known upcoming maneuvers.

Lead KV 56 prepares to engage the target cloud from the incoming enemy missile. The lead KV 56 reports its health status, receives non-KV observational data updates such as its radar Target Object Map (TOM) or EO/IR data from space based assets from a ground communications site 61, and initiates target acquisition. The lead KV has acquired an image of the inbound target cloud when it gets close enough to see the main objects from the enemy missile. The lead KV uses the radar image in the TOM with the IR scene ahead to help identify objects in the target cloud. The lead KV discriminates the most credible targets from obvious missile debris using the measures IR properties and radar TOM information. The lead KV, for example, identifies two types of credible signatures in the target cloud; five A type signatures, and one B type signature. Without additional information, the KVs will attack the A signature targets in turn, then the B signature target. Lead KV 56 selects its target, transmits its observational sensor data and processed mission data to the first follower KV 58 and makes the first intercept attempt.

The first follower KV 58 receives a fully categorized map of the target cloud (i.e., the MOT) in real time, even though it has yet to see the target cloud. The first follower KV uses its ground communications antenna to transmit the data from the lead KV 56 to the command center 46 and receives its own updated radar TOM in return. The first follower KV 58 forwards the updated radar TOM to the lead KV 56 and prepares to observe the first intercept and report the results.

The Lead KV's IR MOT, discrimination results, and select target arrive at the command center from the first follower KV. This data gives the commander the first direct view of the incoming threat. This information can be used both to manage the current strategic engagement as well as to inform target discrimination and selection for future engagements.

The lead KV 56 closes in on the target as follower KV 58 closes into range where it can see both the lead KV 56 and its intended target. Follower KV 58 knows the expected time of intercept and stands ready for the lead KV's final report on what it sees when it gets close.

As the lead KV 56 closes in on the target, it is able to see a resolved image at close range. In a scenario, at the last moment, the lead KV 56 realizes it has just attacked a probable decoy. In its last instant, the lead KV 56 transmits a code to follower KV 58 to warn of what it has learned, then destroys its target. The balloon decoy the lead KV 56 runs through has too little mass to produce a bright flash, confirming that it was a decoy. An impact sensor on lead KV 56 may be configured to detect an impact force or to even classify the target based on an amount of material consumed by the impact and transmit the impact data.

Follower KV 58 observes the impact and confirms the lead KV decoy report as the successful impact was far too small to account for a warhead. Follower KV 58 relays the results of the lead KV's attack to the second follower KV 60, which is now in position to relay the result to command center 46. The command center receives the report from the second follower KVs 60 on the lead KV engagement and prepares a provisional plan to fire an additional set of interceptors.

First follower KV 58, which has now assumed the position of the lead KV, uses the new data from the lead KV 56 engagement to recognize the four remaining targets with an A type are probable decoys, and rejects them as targets. First follower KV 58 reevaluates the target cloud using the new criterion, selects the credible threat with signature B as its new target and transmits the updated map to second follower KVs 60.

First follower KV 58 turns to track its new target and makes a large divert burn to intercept. First follower KV 58 closes with the new target as second follower KVs 60 prepare to observe the intercept. At close range, first follower KV 58 sees it's clearly a warhead, and it's going to be a good hit. First follower KV 58 transmits its findings and impacts the warhead. The impact sensor senses and transmits impact data indicative of a warhead impact before KV 58 is consumed by the impact.

Second follower KVs 60 confirms the flash of a massive impact consistent with follower KV 58's report of a successful warhead intercept. Second follower KVs 60 report the news to command center 46 and engage the next highest priority object. Command center 46 sees a successful intercept has taken place. There is no need to commit an additional salvo of GBIs to engage everything in the target cloud.

Figure 3:
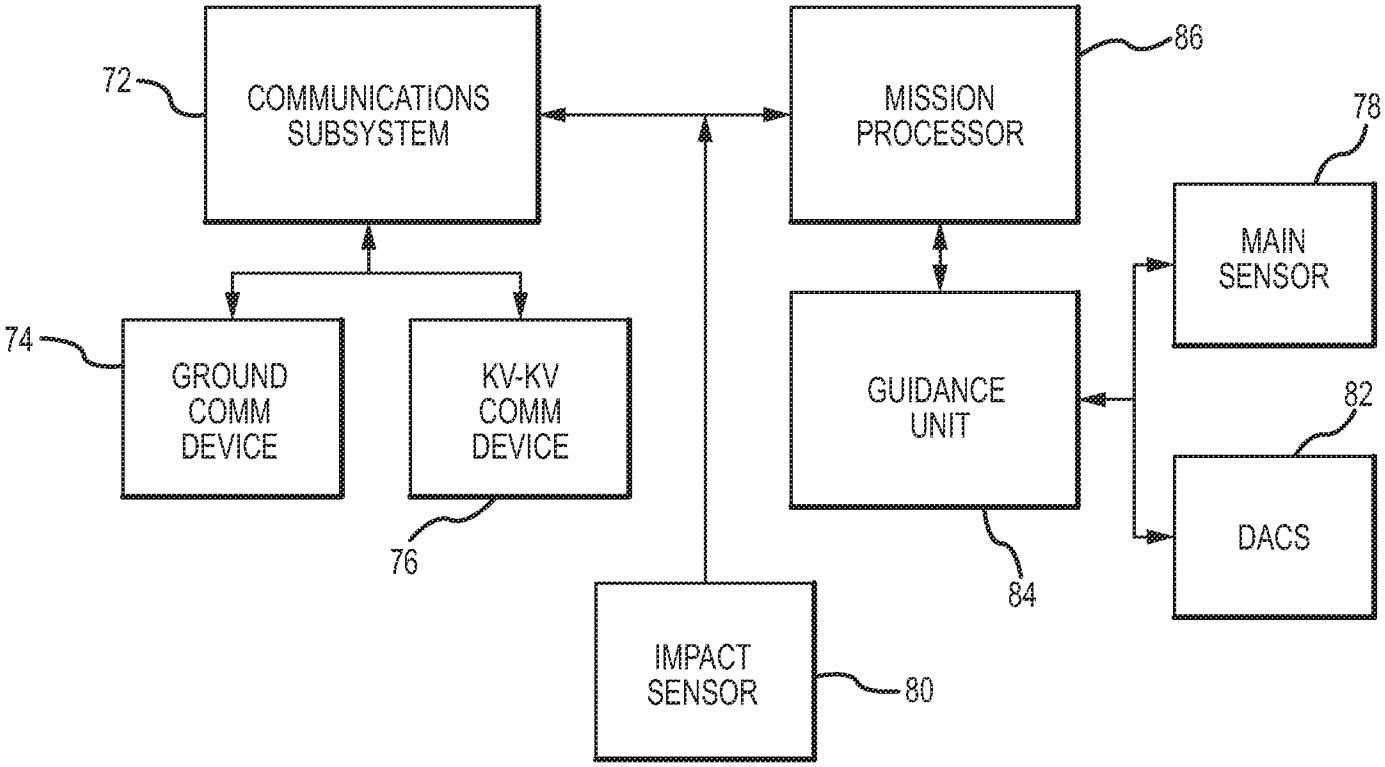
FIG. 3 is a system block diagram of a KV.

Referring now to FIG. 3, an autonomous KV suitable for use as a lead or follower KV requires certain additional capability not present in existing KVs e.g. long-range KV-to-KV communications, impact sensor and data integration. This capability may be provided by retrofitting existing KVs or by redesigning the KV.

The autonomous kill vehicle (KV) includes a communications subsystem 72 including a bi-directional ground communications device 74, a bi-directional long-range KV-to-KV communications device 76 to communicate with the other KVs in the string, an inertial measurement system including an IMU and an optional GPS (provides improved position localization of the KV) to determine the KV's position and orientation, a main sensor 78 (such as a passive one or two color LWIR sensor) configured to image a determined target volume of a target cloud and provide discrimination to support target selection, an impact sensor 80 configured to sense target impact and transmit impact data, a divert attitude control system (DACS) 82 with kinematic reach to remove insertion error and prosecute the determined target volume, a mission processor 86 configured to integrated non-KV observational data received from the ground, its own observational sensor data and the observation sensor data received from the lead KV to autonomously select a target and determine maneuvers to engage the target and a guidance unit 84 configured to track the position and orientation of the KV and to execute maneuvers received from the mission processor.

The ground communications device 74 on existing KVs is a "tilted" communications link subsystem (CLS) antenna. This antenna is designed for ground communications as the KV passes over the ground command center. Once the KV has acquired the target, communication via the CLS antenna would require reorienting the KV, which is not done. Consequently existing KVs cannot send or receive information once the target has been acquired.

An autonomous lead/follower KV must have the capability to send and receive information post-acquisition without having to reorient the KV. Such post-acquisition communication cannot interfere with prosecution of the target. To this end, a lead/follower KV is provided with additional long-range KV-to-KV communications capability. This capability may be in addition to and separate from the tilted CLS antenna or integrated in a new communications device that provides both the KV-to-ground and KV-to-KV communications both pre and post-acquisition. The KV-to-KV communications device 76 might include, for example, fixed front and rear facing antennas mounted forward and aft of the KV, a gimbaled antenna or a gimbaled laser. The particular configuration will depend on whether this is a retrofit or new design and other mission factors.

The mission processor 86 on existing KVs is configured to integrated non-KV observational data received from the ground and its own observational sensor data to autonomously select and engage a target. The mission processor 86 is reconfigured to further integrate the observational sensor data and processed mission data received from the lead KV. The observational sensor data and processed mission data is suitably in the exact same format as the data already processed by the KV and thus is directly usable by a follower KV.

Figure 4:
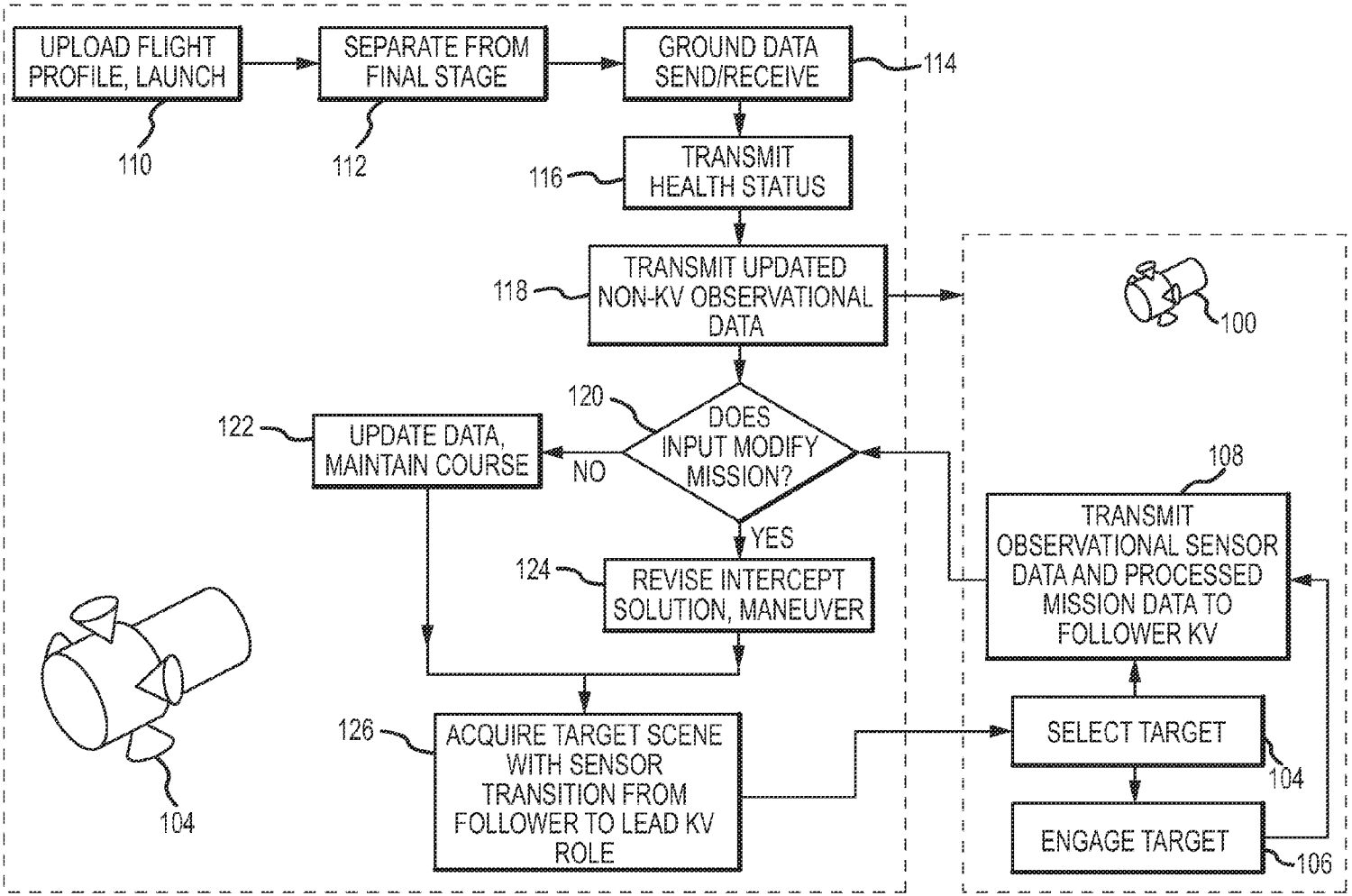
FIG. 4 is a flow diagram of leader-follower KV interaction.

An embodiment of the functions performed by and the interactions between a lead KV 100 and a follower KV 102 to cooperatively engage a target cloud is illustrated in FIG. 4. Lead KV 100 processes the non-KV observational sensor data (e.g., the TOM radar update) it received from the ground or a more recent update pass forward from the follower KV and its own mission data and observational sensor data to select a target (step 104) and engage the target (step 106). The lead KV 100 periodically transmits its observational sensor data and processed mission data from acquisition through impact to the follower KV (step 108).

The following interceptor uploads a flight profile and is launched on a ballistic intercept trajectory (step 110). Follower KV 102 separates from the final booster stage (step 112) and continues on the intercept trajectory. As the follower KV 102 passes over the ground station it conducts a ground data send and receive (step 114) to receive updated non-KV observational sensor data and other mission data and to transmit processed mission data and observation sensor data from itself and the lead KV and to transmit its health status (step 116). The follower KV 102 may also transmit any updated non-KV observational sensor data or other mission data forward to lead KV 100 (step 118). As a result, even the lead KV 100 has better and more recent data to engage the target cloud in the leader/follower scenario.

Follower KV 102 integrates the data received from the lead KV with its own observational sensor data and non-KV sensor data and autonomously decides whether to modify its mission (step 120). If not, the follower KV updates the processed mission data and maintains course (step 122). If yes, the follower KV revises the intercept solutions and performs a maneuver (step 124). Pre-acquisition the follower KV will base its determination on the non-KV sensor data received from the ground and the observational sensor data received from the lead KV. Post-acquisition the follower KV will integrate all sources of data. Upon acquisition, the follower KV transitions to the roll of lead KV (step 126). Depending upon the spacing of the lead and follower KVs, the follower KV may transition before or after the lead KV impacts the target.

Figure 5A:
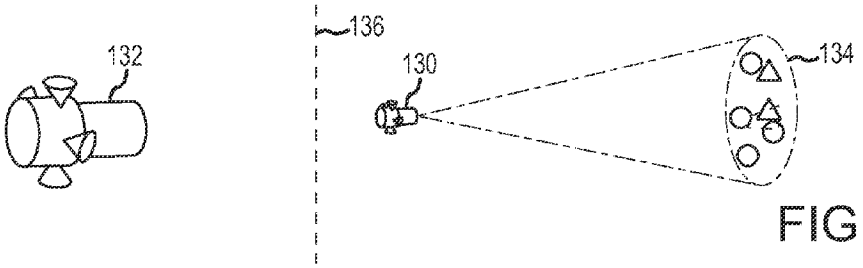
FIGS. 5*a* through 5*c* are diagrams of the string of KVs and target cloud at different times in the engagement.
Figure 5B:
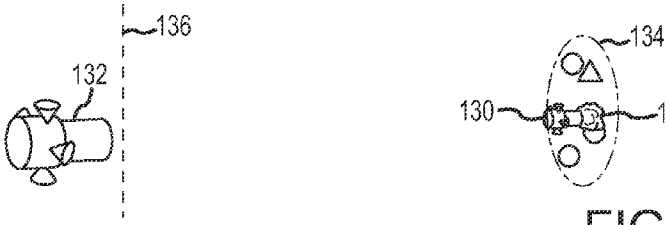
Figure 5C:
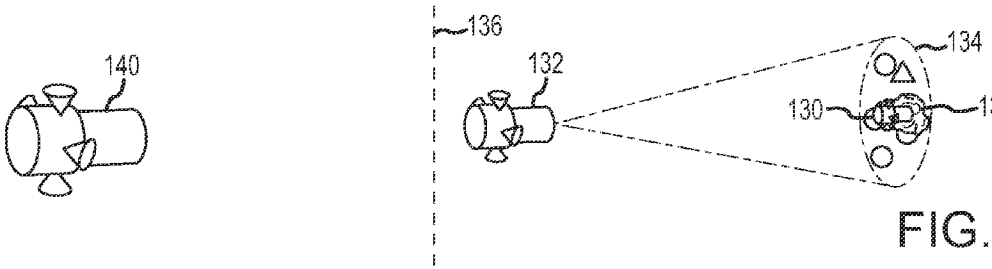

FIGS. 5*a*, 5*b* and 5*c* depict different spacing scenarios for a lead KV 130, a follower KV 132 and any subsequent follower KVs to engage a target cloud 134. As shown in FIG. 5*a*, the lead and follower KVs are spaced such that the lead KV 130 acquires the target cloud 134 and initiates transmission of its observational sensor data and processed mission data before follower KV 132 is within range 136 to acquire the target. The follower KV selects the target and maneuvers based on these initial transmissions. By making its initial maneuver pre-acquisition, the follower KV can conserve fuel for terminal maneuvers. This also enables less-capable KVs, ones with limited sense or maneuver capability, to be used as follower KVs.

As shown in FIG. 5*b*, lead KV 130 has impacted a target 138 in the target cloud and sent a final transmission before follower KV 132 is within range 136 to acquire the target. The follower KV may be able to detect a bright flash indicative of a successful impact with a warhead. The KVs may be spaced to the limits of the communications link to maximize the benefits of an early maneuver.

As shown in FIG. 5*c*, follower KV 132 has moved within range 136 and acquired the target cloud by the time lead KV 130 impacts a target 138 and sends its final transmission. The follower KV can see the impact of lead KV with the target to gather additional information relevant to informing target selection and transitions to the roll as the lead KV. A second follower KV 140 is now in position to receive transmissions from the new lead KV.

KVs are kinetic-energy based vehicles that destroy a target based solely on the high-speed impact of the vehicle with the target, there is no warhead, explosive or otherwise, to destroy the target. As previously discussed, existing KVs do not have the capability to transmit data e.g., impact data, post-acquisition. As such, existing KVs do not include an impact sensor to trigger detonation of a warhead.

Leader/follower KVs have the capability to transmit data post-acquisition and even after impact with a target until the KV itself is destroyed. Impact Sensing Capability, when combined with the KV-to-KV communications, would enable the lead KV to send an impact assessment to the follower KV, and back to the command center. In the event of an assured warhead "kill", the follower KV would attempt to intercept the next highest probability warhead like object, and potentially send that information back to command center (either because the follower KV was not yet in the acquisition phase—this would relate to KV launch spacing, or because there were further KVs in the string). If the lead KV missed the primary target, the follower KV would attack it and potentially send that information back to command center. Depending on the KV launch spacing, this could mean the enabling of a "shoot, assess, shoot" firing doctrine, reducing the number of interceptors required to satisfy the Pes.

The ultimate question for threat negation in a missile defense intercept attempt is direct knowledge of what the KV hit. While the basic leader/follower concept allows for the best data from conventional observations to be passed back to the following KV and from there to the engagement command center, impact sensing gives the direct knowledge of what the KV hit. The impact sensor must respond very quickly in order to first sense the impact with a desired temporal resolution and to transmit the data to the follower KV before the lead KV is destroyed. The impact sensor may be configured to sense and transmit data about the force of the collision e.g. a type of threshold sensor, or sense and transmit data that can classify the impacted object e.g. the warhead, a counter measure such as a balloon, or debris.

During hypervelocity collisions, complex phase changes occur, objects act as fluids, there is instantaneous heating, and plasmas are formed. If one of the objects is significantly thicker or denser than the other, damage and reshaping occurs at the surface, but much of the object will survive the collision with the less dense object. If the two objects are of similar density, both will be consumed at roughly the same rate.

An impact sensor configured to classify known objects upon impact comprises a reference material configured such that varying and known amounts of the material are consumed during impact with different objects of known density (and possibly thickness) at closing velocities within a specified range. The reference material may be part of the KV such as the sunshade or it might be a separate high-density material. A probe (e.g. electrical, optical or RF) is positioned along the length of the reference material. The probe is configured to generate an output indicative of the amount of material consumed during impact. The output may be a time sequence of samples of a response caused by consumed material or may be a pulse having a certain height and width indicative of the intensity and duration of the response, respectively. The consumed material may produce a flash that generates the pulse directly or may trigger multiple probes to produce the pulse indirectly. A circuit is configured to readout a probe output and a processor is configured to process the probe output to classify the impacted object as one of the known objects. For example, the measured height and width of the pulse can be used to classify the object. The impact of the KV with a balloon, debris or a hardened warhead produces unique signatures in both intensity and duration. In different embodiments, the probe outputs or object classifications are transmitted from the lead KV to a follower KV before the lead KV is destroyed.

Various embodiments of these types of impact sensors are described in co-pending U.S. patent application Ser. No. 14/730,746, filed Jun. 4, 2015, entitled "Hyper-Velocity Impact Sensor", which is hereby incorporated by reference. One such embodiment is described below.

Figure 6A:
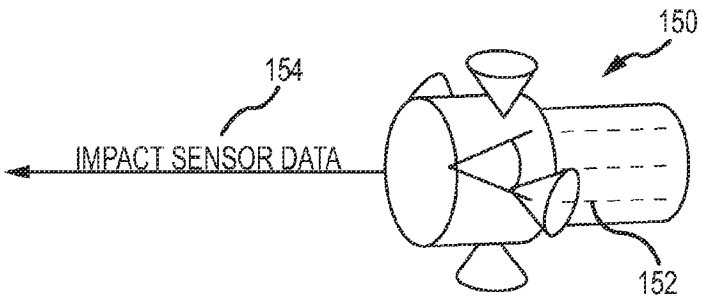
FIGS. 6*a* and 6*b* are diagrams of an embodiment of a KV configured with an impact sensor and a fiber optic configuration of the impact sensor.
Figure 6B:
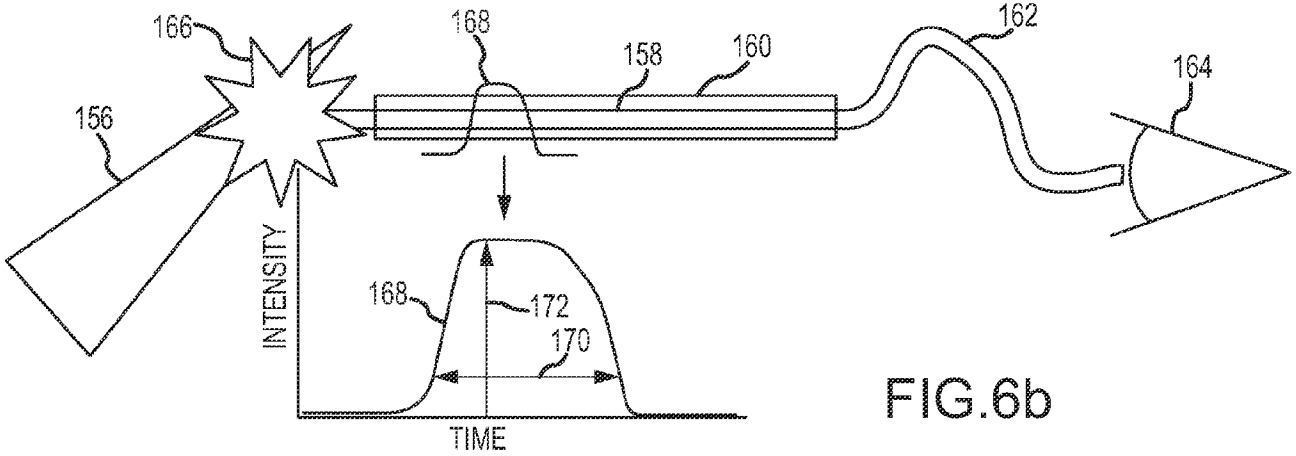

Referring now to FIGS. 6*a* and 6*b*, a KV 150 is provided with an impact sensor 152 that is configured to sense and transmit impact data 154 that classifies (or can be processed to classify) the impacted object 156. In an embodiment, the impact sensor comprises a fiber optic probe 158 along the length of a reference material 160. Reference material 160 may be the fiber optic probe itself, an existing portion of the KV such as the sunshade or a separate length of material such as a dense penetrating rod. Multiple fiber optic probes 158 may be positioned on the KV. A connecting fiber 162 connects the fiber optic probe 158 to an optical detector 164. At impact, optical detector 164 reads out a time sequence of optical intensities. The raw intensity data or a code word are transmitted from the lead KV to a following KV before the lead KV is destroyed. A analogous electrical configuration utilizes a 2-wire or coax cable probe and an electrical readout. The plasma produces an electrical pulse that travels down the probe.

The fiber optic probe 158, and reference material 160, will be partially consumed along its length as a hypervelocity collision occurs. For thin, low density targets, small portions of the probe/material will be consumed, while dense or thick targets, much more or all of the fiber/material will be consumed. Plasma formation and the heat 166 generated in the collision will generate an optical pulse 168 both inside and outside the fiber optic probe, and the pulse in the fiber will travel down the probe at approximately two-thirds the speed of light through connecting fiber 162 to optical detector 164 where its pulse width 170 and height 172 can be measured.

Pulse height will be proportional to the kinetic energy of the collision, $\frac{1}{2}\, m\, v^2$, providing density and velocity information. Pulse width will be proportional to the time the probe travels through the target, providing velocity and thickness information. Thin, light objects such as decoys produce low intensity, short duration pulses. Thick, heavy objects such as the warhead produce high intensity, long duration pulses. The density and thickness of objects, and mass consumed, can be calculated or inferred from the pulse height and pulse width and used to classify the impacted object. Multiple pulses indicate multiple surfaces have been penetrated (front/back of balloon, front/back of fuel tank, reentry vehicle skin/warhead, etc.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A method of intercepting ballistic targets, comprising:

launching a lead interceptor having a lead kill vehicle (KV) on a first ballistic trajectory to intercept a target cloud, separating the lead KV from the lead interceptor, launching a follower interceptor having a first follower KV on a second ballistic trajectory to intercept the target cloud, separating the first follower KV from the follower interceptor in a trailing relationship to the lead KV, from the lead KV, collecting and processing observational sensor data to discriminate targets within the target cloud and to select a target from the target cloud autonomously, maneuvering the lead KV to remove insertion error of the lead KV and intercept the selected target and transmitting the observational sensor data and processed mission data via a first communications link, and from the first follower KV, receiving the observational sensor data and processed mission data from the lead KV via a second communications link, collecting observational sensor data, processing both the received observational sensor data from the lead KV and its own observational sensor data to discriminate targets and select a target from the target cloud autonomously, and maneuvering the follower KV to remove insertion error of the follower KV and intercept the selected target.

2. The method of claim 1, further comprising:

launching another follower interceptor having a second follower KV on a third ballistic trajectory to intercept the target cloud, separating the second follower KV from the third interceptor in a trailing relationship to the first follower KV, and from the second follower KV, receiving the observational sensor data and processed mission data from the first follower KV via a third communications link, collecting observational sensor data to discriminate targets within the target cloud, autonomously processing both the received observational sensor data from the first follower KV and its own observational sensor data to select the target from the target cloud, and maneuvering the second follower KV to remove insertion error of the second follower KV and intercept the selected target.

3. The method of claim 1, further comprising timing the launch of the follower interceptor relative to the launch of the lead interceptor to space the lead KV and first follower KV such that the first follower KV receives an initial transmission of the observational sensor data and processed mission data from the lead KV before the first follower KV is within range to acquire the target cloud and discriminate targets from its own observational sensor data, said first follower KV selects the target and maneuvers based on said initial transmission of the observational sensor data and processed mission data.

4. The method of claim 3, further comprising timing the launch of the follower interceptor relative to the launch of the lead interceptor to space the lead KV and first follower KV such that the first follower KV receives a final transmission of the observational sensor data and processed mission data from the lead KV at target intercept before the first follower KV is within range to acquire the target cloud and discriminate targets from its own observational sensor data, said first follower KV selects the target and maneuvers based on the final transmission of the observational sensor data and processed mission data.

5. The method of claim 3, further comprising timing the launch of the follower interceptor relative to the launch of the lead interceptor to space the lead KV and first follower KV such that the first follower KV receives a final transmission of the observational sensor data from the lead KV at target interceptor after the first follower KV is within range and has acquired the target cloud to discriminate targets, said first follower KV selects the target and maneuvers based on both the final transmission of the observational sensor data and its own observational sensor data.

6. The method of claim 1, wherein at target intercept by the lead KV, said lead KV collects the observational sensor data and transmits the final observational sensor data and processed mission data just prior to impact.

7. The method of claim 6, wherein the lead KV comprises an impact sensor, wherein said lead KV collects impact data and transmits impact sensor data after impact wherein the first follower KV processes the impact sensor data to inform its own target selection.

8. The method of claim 7, wherein the first follower KV processes the received impact sensor data to classify the impacted target to inform its own target selection.

9. The method of claim 6, where said first follower KV collects observational sensor data of the lead KV impacting the target to inform its target selection.

10. The method of claim 1, wherein a plurality of N interceptors are launched in a spaced sequence to intercept the target cloud, wherein said observational sensor data and processed mission data is passed backwards from one KV to the next, further comprising:

as each KV passes over a surface-based station, transmitting the observational sensor data and processed mission data down to the surface-based station.

11. The method of claim 1, wherein a plurality of N interceptors are launched in a spaced sequence to intercept the target cloud, further comprising:

as each KV passes over a surface-based station, transmitting updated processed non-KV observational sensor data up to the KV; and from the uplinked KV, transmitting the updated processed non-KV observational sensor data forward from one KV to the next.

12. The method of claim 1, wherein the lead interceptor is a unitary interceptor with a single lead KV.

13. The method of claim 12, wherein the follower interceptor is a unitary interceptor with a single first follower KV, said first and second interceptors and KVs being interchangeable.

14. The method of claim 12, wherein the follower interceptor is a unitary interceptor with single first KV, wherein said first follower KV has less sensor or maneuver capability than said lead KV.

15. The method of claim 12, wherein the follower interceptor is a multiple KV interceptor with a plurality of first follower KVs.

16. A missile defense system, comprising:

a lead interceptor including boost capability to launch the interceptor on a first ballistic trajectory to intercept a target cloud, said interceptor including a lead kill vehicle (KV) having a sensor subsystem for collecting observational sensor data to discriminate targets within the target cloud, a mission processor configured to autonomously process the observational sensor data to select a target from the target cloud, a propulsion system with a kinematic reach to remove insertion error of the lead KV and intercept the selected target and a communications link for transmitting the observational sensor data and processed mission data;

a trail interceptor including boost capability to launch the interceptor on a second ballistic trajectory to intercept the target cloud, said trail interceptor including a first follower KV having a communications link configured to receive the observational sensor data and processed mission data from the lead KV, a sensor subsystem for collecting observational sensor data to discriminate targets within the target cloud, a mission processor configured to autonomously process both the received observational sensor data from the lead KV and its own observational sensor data to select a target from the target cloud and a propulsion system with a kinematic reach to remove insertion error of the first follower KV and intercept the selected target; and a launch controller configured to time the launch of the trail interceptor relative to the launch of the lead interceptor to put the follower KV in a trailing relationship to the lead KV.

17. The missile defense system of claim 16, wherein the launch controller is further configured to time the launch of the trail interceptor to space the lead and first follower KVs such that the first follower KV receives an initial transmission of the observational sensor data and processed mission data from the lead KV before the first follower KV is within range to acquire the target cloud and discriminate targets from its own observational sensor data, said first follower KV configured to select the target and maneuver based on the initial transmission.

18. The missile defense system of claim 16, wherein the lead KV comprises an impact sensor, wherein said lead KV collects impact data and transmits impact sensor data after impact, wherein the first follower KV processes the impact sensor data to inform its own target selection.

19. The missile defense system of claim 18, wherein the impact sensor comprises:

a reference material configured such that varying and known amounts of the material are consumed during impact with different known objects in the target cloud of known density at closing velocities within a specified range;

a probe along the length of the reference material, said probe configured to generate an output indicative of the amount of material consumed during impact; and a circuit configured to readout a probe output as the impact sensor data, wherein the first follower KV processes the impact sensor data to classify the impacted target as one of the different known objects to inform its target selection.

20. The missile defense system of claim 18, further comprising a surface-based station, wherein the launch controller is configured to launch a plurality of N interceptors in a spaced sequence to intercept the target cloud, wherein said observational sensor data and processed mission data is passed backwards from one KV to the next and down to the surface-based station as each KV passes over the surface-based station.

21. The missile defense system of claim 18, further comprising a surface-based station, wherein the launch controller is configured to launch a plurality of N interceptors in a spaced sequence to intercept the target cloud, said surface-based station transmitting updated processed non-KV observational sensor data up to each KV as it passes over and forward from one KV to the next.

* * * * *